United States Patent [19]

Simkins

[11] Patent Number: 4,681,216

[45] Date of Patent: Jul. 21, 1987

[54] DISPLAY CASE FOR FRAGRANCE BOTTLES, JEWELRY, OR THE LIKE, AND HINGE USED THEREIN

[75] Inventor: Philip P. Simkins, New York, N.Y.

[73] Assignee: Steven W. Hewitt, Mt. Kisco, N.Y.; a part interest

[21] Appl. No.: 872,670

[22] Filed: Jun. 10, 1986

[51] Int. Cl.[4] ..... B65D 79/00

[52] U.S. Cl. ..... 206/45.13; 206/45.14; 206/45.2; 16/387; 108/128

[58] Field of Search ..... 206/45.13, 45.14, 45.19, 206/45.2, 45.23; 108/128, 129; 16/225, 387, 390, DIG. 13

[56] References Cited

U.S. PATENT DOCUMENTS

| | | | |
|---|---|---|---|
| 2,199,008 | 4/1940 | Oshei | 206/75 |
| 2,262,472 | 11/1941 | Sloan | 206/45.13 |
| 2,930,160 | 3/1960 | Pohl | 45/28 |
| 3,402,806 | 9/1968 | Sutherland et al. | 206/82 |
| 3,709,159 | 1/1973 | Oglesby | 108/129 X |
| 3,750,192 | 8/1973 | Beresic | 2/185 R |
| 3,784,046 | 1/1974 | Cata | 220/35 |
| 4,005,661 | 2/1977 | Mason | 108/128 |
| 4,323,153 | 4/1982 | Courtin | 206/45.13 |
| 4,563,381 | 1/1986 | Woodland | 428/156 |

FOREIGN PATENT DOCUMENTS

| | | | |
|---|---|---|---|
| 965232 | 9/1950 | France | 206/45.14 |

*Primary Examiner*—Stephen Marcus
*Assistant Examiner*—Michael Shea
*Attorney, Agent, or Firm*—Wayne M. Kennard

[57] ABSTRACT

A display case (100) for displaying fragrance bottles, jewelry, or the like, having an enclosure member (102) defining a cavity, with the enclosure member (102) comprising first and second sections (104, 106), a tray (126) having a shape and size enabling its disposition within the cavity in the enclosure member 102, and a hinge (300) for hingedly connecting the first and second sections (104, 106) of the enclosure member (102) and the tray (126) and for enabling the display case (100) to be opened and closed to display and conceal the tray (126) and the fragrance bottle, jewelry, or the like, carried by the tray (126).

7 Claims, 5 Drawing Figures

DISPLAY CASE FOR FRAGRANCE BOTTLES, JEWELRY, OR THE LIKE, AND HINGE USED THEREIN

TECHNICAL FIELD

The field of the present invention relates to novel display cases used for displaying fragrances, jewelry, or the like, and a novel hinge used for connecting the elements of the display cases. More specifically, the field of the invention relates to display cases that have an enclosure member defining a cavity, with the enclosure member comprising two sections, a tray for supporting a fragrance bottle, jewelry, or the like, which is housed within the enclosure member when the display case is closed and displayed when the display is opened, and a hinge for hingedly connecting the separate sections of the enclosure member and the tray, and enabling opening and closure of such display cases.

BACKGROUND ART

There have been various constructions of display cases for fragrance bottles, jewelry, or the like, having a myriad of sizes and shapes (U.S. Pat. Nos. 2,199,088; 2,930,160; 3,402,806; 3,750,192; 3,784,046; and 4,323,153). However, the prior art does not disclose display cases which have an enclosure member defining a cavity, with the enclosure member comprising two sections that are mirror images of one another, a tray for supporting the fragrance bottle, jewelry, or the like, housed within the enclosure member, and a hinge that connects the two sections of the enclosure member and the tray in such a manner that when the enclosure member is opened to display the fragrance bottle, jewelry, or the like, in the tray, the tray is supported to prevent rotational movement about a common hinge point among the two sections of the enclosure member and the tray.

Therefore, the prior art does not disclose the novel features of the display case of the present invention.

SUMMARY OF THE INVENTION

The present invention is a display case for fragrance bottles, jewelry, or the like. The display case of the present invention has an enclosure member that defines an interior cavity. The enclosure member comprises two equal sections. The two sections are mirror images of one another. Each is hollow and substantially defines one half of the cavity in the enclosure member. The display case has a tray with a shape and size that enables it to be housed within the enclosure cavity when the display case is closed and fully displayed when open. Preferably, the tray has a shape that substantially the same as the shape of the cavity within the enclosure member but of a lesser size.

The hinge of the display case is used for hingedly connecting the two sections of the enclosure member and the tray. The hinge has first, second and third elongated members which connect at a common hinge point. The common hinge point is located approximately midway along the longitudinal length of the first elongated member. The second and third elongated members have one of their ends connected to the common hinge point.

The hinge also has two support members, which are respectively connected between the first and second elongated members, and the first and third elongated members. The two support members prevent rotation of the first elongated member about the common hinge point when the second and third elongated members are orthogonal to the plane of the first elongated member.

The hinge connects to the two sections of the enclosure member and tray in the following manner. The first elongated member is connected to the exterior surface of the base of the tray, and the second and third elongated members are connected to the inside surfaces of the bases of the two hollow sections forming the enclosure member, respectively. When the display case is opened displaying the tray supporting the fragrance bottles, jewelry, or the like, the support members are fully extended and obliquely disposed between the first and second elongated members of the hinge, and the first and third elongated members of the hinge, preventing rotational movement of the tray about the common hinge point, thereby, stabilizing the tray. And, when the display case is closed, each support member folds between respective portions of the first elongated members and the second and third elongated members, respectively, to which each attaches.

An object of the invention is to provide a display case for fragrance bottles, jewelry, or the like, which has an enclosure member defining an interior cavity, with the enclosure member being divided into two mirror image sections, a tray for disposition within the cavity in the enclosure member, with the tray being housed within the cavity when the display case is closed and fully displayed when the display case is opened, and a hinge connecting the two sections of the enclosure member and the tray, with the hinge being constructed so that the tray is stabilized from rotational movement about a common hinge point among the two sections of the enclosure member and the tray when the display case is opened.

A further object of the invention is to provide a display case hinge for hingedly connecting the two sections of an enclosure member defining a cavity and a tray housed in the cavity, with the hinge having a first elongated member connected to the tray, and second and third elongated members connected to the two sections of the enclosure member, respectively, with the hinge also having support members connected between the first and second elongated members, and the first and third elongated members for preventing rotational movement of the tray about a common hinge point among the hinge members when the display case is opened.

These and other objects will be explained in greater detail subsequently.

BEST MODE FOR CARRYING OUT THE INVENTION

The present invention is a display case for fragrance bottles, jewelry the like.

Figure 1:
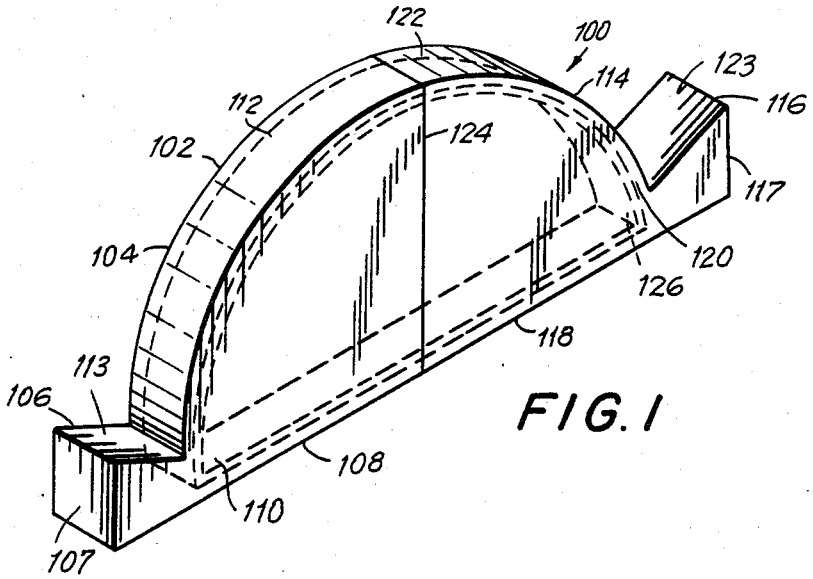
FIG. 1 shows a top perspective view of the preferred embodiment of the display case of the invention closed with the tray housed within the display case shown in phanton.

FIG. 1 shows the preferred embodiment of display case 100 closed with tray 126 housed within display case 100 shown in phantom. Display case 100 comprises enclosure member 102, defining an interior cavity, tray 126 and hinge 300 (FIG. 5) for hingedly connecting tray 126 to enclosure member 102.

Enclosure member 102 comprises mirror image sections 104 and 114. Line of separation 124 shows the division of enclosure member 102 into sections 104 and 114. Section 104 has spaced apart, parallel, matched faces having substantially quarter circular shapes with a truncated right triangular extension for handle 106 extending from the end of the respective faces remote from line of separation 124. In FIG. 1, only face 110 is shown, but it is understood that a second face that matches face 110 is disposed on the opposite side of section 104 not shown in this Figure. The peripheral edges of the spaced apart, parallel, matched faces of section 104 are joined by base 108, curved top 112 with upwardly angled portion 113 and end member 107. This construction gives section 104 a predetermined width and a rectangular opening for access into section 104.

Section 114, as stated, is a mirror image of section 104. As such, it also has spaced apart, parallel, matched faces having substantially quarter circular shapes with a truncated right triangular extension for handle 116 extending from the end of the respective faces remove from line of separation 124. In FIG. 1, only face 120 is shown, but it is understood that a second face that matches face 120 is disposed in the opposite side of section 114 not shown in this Figure. The peripheral edges of the spaced apart, parallel, matched faces of section 114 are joined by base 118, curved to 122 with upwardly angled portion 123 and end member 117. This construction gives section 114 the same predetermined width as section 104, and a rectangular opening for access into section 114.

As shown in FIG. 1, when sections 104 and 114 are disposed so the edges of their openings are adjacent one another, the interior cavity of enclosure member 102 is formed for receiving tray 126. The relationship between the shape and size of tray 126 and the shape and size of interior cavity will be discussed subsequently.

Figure 2:
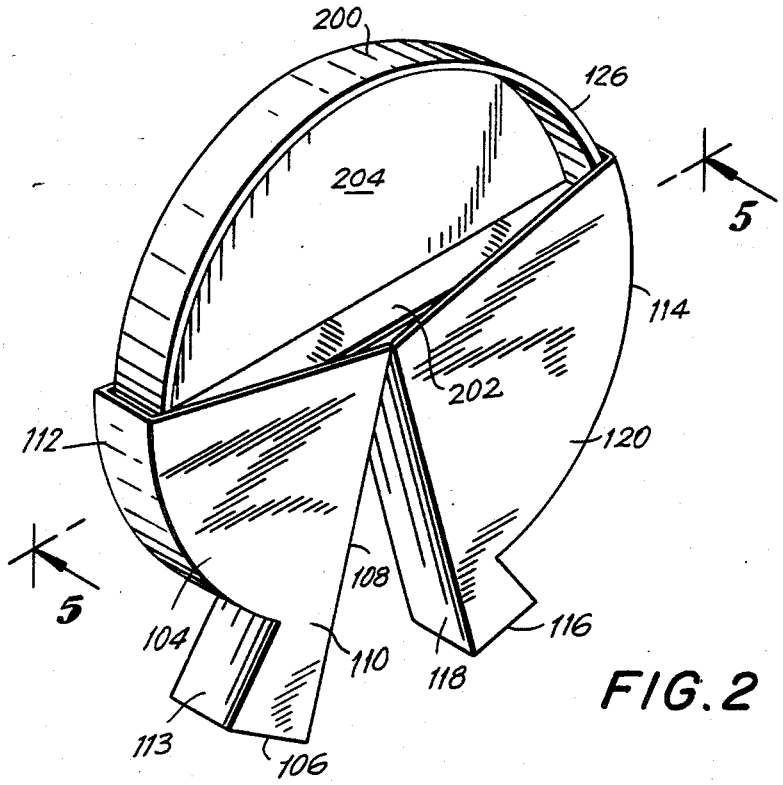
FIG. 2 shows the display case of FIG. 1 partially opened with the tray partially displayed.
Figure 3:
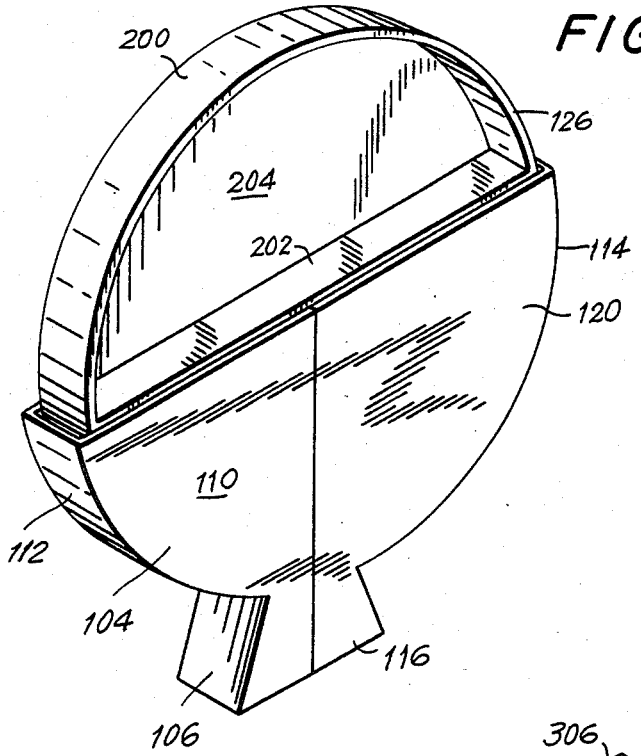
FIG. 3 shows the display case of FIG. 1 fully opened with the tray fully displayed.

FIGS. 1, 2 and 3, when viewed in sequence, show the progressive stages of opening display case 100. In FIG. 1, display case 100 is shown closed. In FIG. 2, display case 100 is shown partially opened. In opening display case 100 to its position shown in FIG. 2, bases 108 and 118 of sections 104 and 114, respectively, are rotated toward one another pivoting about a common hinge point located where the two bases meet. In the partially opened position, tray 126, having curved top 200, base 202 and cavity 204 disposed therein for disposition of a fragrance bottle, jewelry, or the like, is partially uncovered from within the cavity formed by sections 104 and 114. In FIG. 3, display case 100 is shown fully opened. When fully opened, bases 108 and 118 of sections 104 and 114, respectively, are adjacent. As shown, when display case 100 is fully opened, tray 126 is fully displayed so that the contents in cavity 204 can be viewed or removed as desired. Also, sections 104 and 114 can provide a stand for display case 100.

Again referring to FIGS. 1, 2 and 3, the relationship between the shapes and sizes of tray 126 and the interior cavity of enclosure member 102 will be discussed. The cavity within enclosure member 102 is primarily determined by the shape and size of sections 104 and 114. As shown in the preferred embodiment in FIG. 1, the exterior shape of the enclosure member 102 is semi-circular enclosure with a width determined by tops 112 and 122, bases 108 and 118 and end members 107 and 117 of sections 104 and 114, respectively. As such, the interior cavity has substantially the same shape with a slightly lesser size, with the size reduction determined by the thicknesses of the matched faces, bases 108 and 118, tops 112 and 122, and end members 107 and 117 of sections 104 and 114 respectively.

Tray 126, shown fully displayed in FIG. 3, has substantially the same shape as the interior cavity of enclosure member 102, but the size is slightly less so it can fit within the cavity in enclosure member 102. By the interior cavity of enclosure member 102 and the exterior of tray 126 having the above described shape and size relationship, tray 126 with cavity 204 subtantially utilizes the maximum available space within enclosure member 102 for disposition of a fragrance bottle, jewelry or the like, while still fitting within the cavity and enabling easy opening and closure of display case 100. This means that in opening and closing display case 100, sections 104 and 114 can freely pivot about the common hinge point among the two sections and tray 126 to display or conceal tray 126 without contact between tray 126 and the interior surfaces of sections 104 and 114.

The above description of enclosure member 102, sections 104 and 114 of enclosure member 102, and tray 126, with respect to their shape and size, is directed to the preferred embodiment of display case 100 of the invention. However, it is understood that sections 104 and 114 can be configured so that there is no relationship between the exterior shape and size of sections 104 and 114, and the shape and size of the interior cavity of enclosure member 102. Further, it is understood that enclosure member 102 can be sectioned differently and still be within the scope of the invention. Likewise, tray 126 can have different size or shape characteristics making it totally dissimilar to the shape and size of the interior cavity as long as it can fit within the interior cavity of enclosure member 102 and not contact the interior surfaces of the cavity of enclosure member 102 formed by sections 104 and 114 when sections 104 and 114 are pivoted about the common hinge point to display or conceal tray 126.

Figure 4:
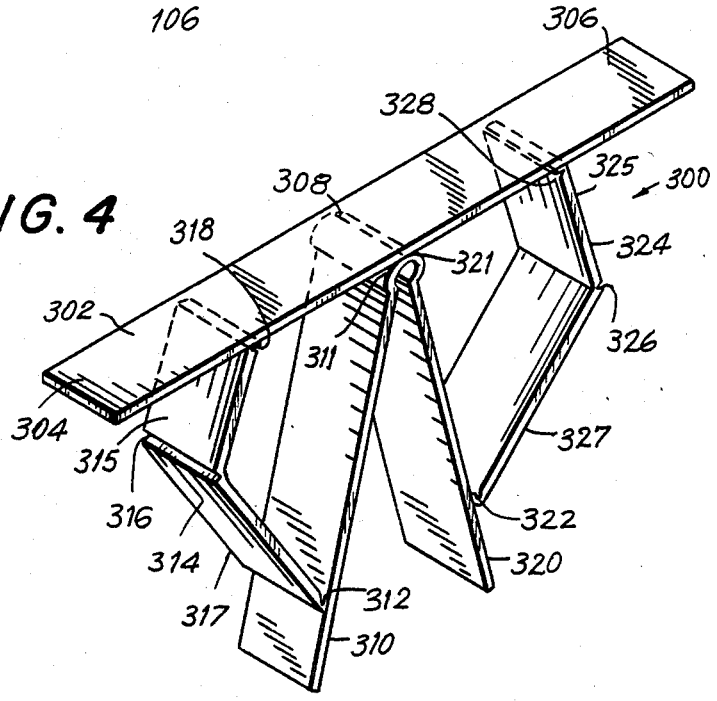
FIG. 4 shows a top perspective view of the hinge used for hingedly connecting the elements of the display case shown in FIGS. 1, 2 and 3.
Figure 5:
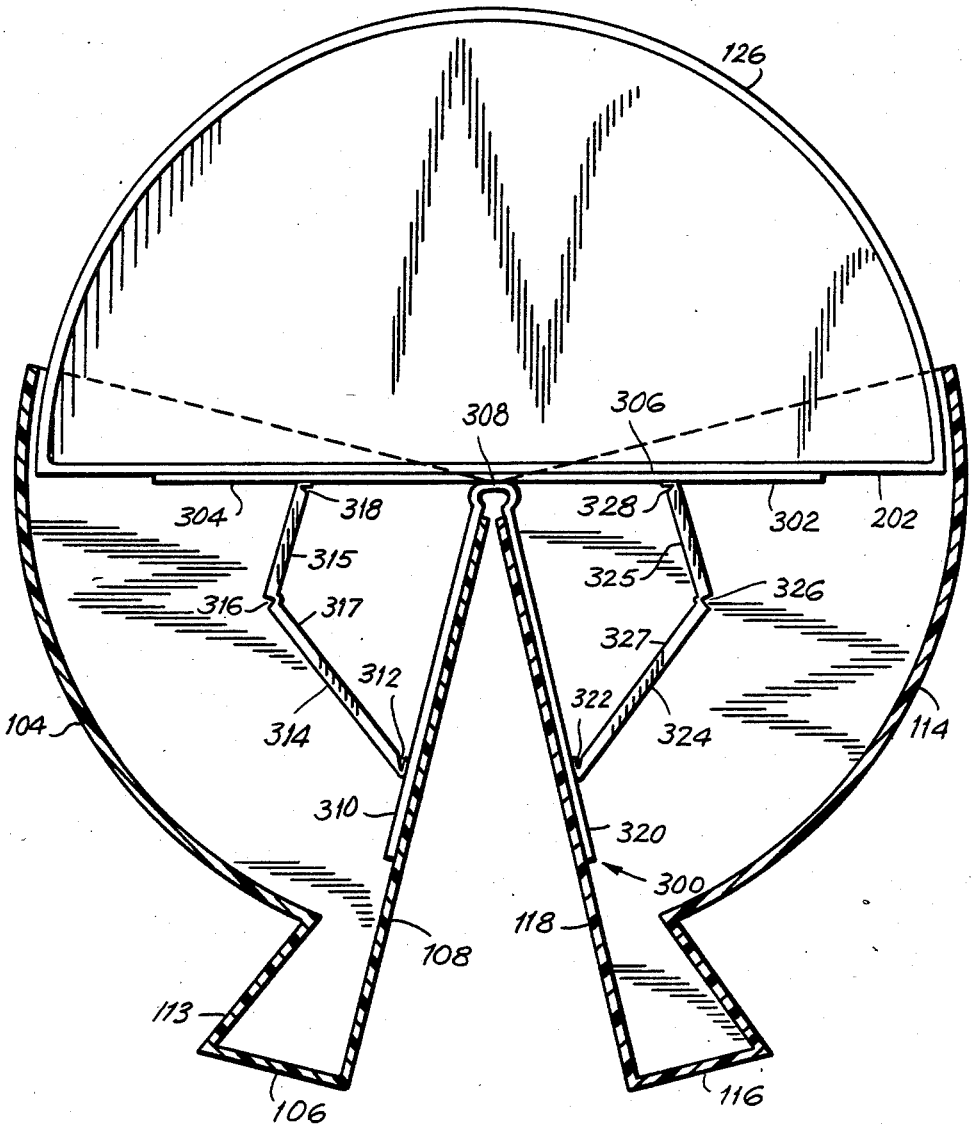
FIG. 5 is a cross-sectional view of the display case along 5—5 of FIG. 2.

Referring to FIGS. 4 and 5, hinge 300 for hingedly connecting sections 104 and 114, and tray 126 will be described. As previously stated, but not described in detail, hinge 300 hingedly connects sections 104 and 114, and tray 126. The elements of hinge 300 will first be described, then its points of attachment to sections 104 and 114, and tray 126 will be described.

Referring to FIG. 4, a top perspective view of hinge 300 is shown. Hinge 300 is preferably constructed of a thermoplastic material which will permit a large number of flexures without failure. However, it is understood that other materials can be used as long as they will carry out the desired hinging function according to the invention.

Hinge 300 has a first elongated strip member 302. Disposed from the lower surface of first elongated strip member 302 are second and third elongated strip members 310 and 320. Second and third elongated strip members 310 and 320, respectively, are disposed from first elongated strip member 302 at common hinge point 308 transversely disposed across it. The proximal ends of second and third elongated strip member 310 and 320, respectively, fixed to first elongated strip 302 member at common hinge point 308, have opposing outwardly curved portions 311 and 321, respectively. Curved portions 311 and 321 allow the edges of the rectangular openings of sections 104 and 114 to abut one another along line of separation 124 when display case 100 is closed, as shown in FIG. 1, and for bases 108 and 118 to lie flush against one another when the display case is fully opened, as shown in FIG. 3.

Again referring to FIG. 4, first support member 314 is disposed between section 304 of first elongated strip member 302 and second elongated strip member 310, and second support member 324 is disposed between section 306 of first elongated strip member 302 and third elongated strip member 320. First support member 314 attaches to the lower surface of section 304 of first elongated strip member 302 at 318, and second elongated strip member 310 at 312. First support member 314 has first arm 315 and second arm 317 connected by fold line 316 disposed transversely across first support member 314 at subtantially the midpoint along its longitudinal length. Fold line 316 acts as a hinge between first arm 315 and second arm 317 and enables first support member 314 to fold outwardly, away from common hinge point 308, when second elongated strip member 310 is pivoted about common hinge point 308 toward section 304 of first elongated strip member 302. So, when second elongated member 310 is pivoted about common hinge point 308 adjacent to section 304 of first elongated strip member 302, first arm 315 and second arm 317 of first support member 314 hinge about fold line 316 to a parallel relationship between adjacent surfaces of section 304 of first elongated strip member 302 and second elongated strip member 310. When second elongated strip member 310 is pivoted about common hinge point 308, so it is substantially orthogonal to the plane of first elongated strip member 302, first support member 314 is fully extended and obliquely disposed between elongated strip members 302 and 310 preventing further pivotal rotation of second elongated strip member 310 away from section 304 of first elongated strip member 302.

Second support member 324 attaches to the lower surface of section 306 of first elongated strip member 302 at 328, and third elongated strip member 320 at 322. Second support member 24 has third arm 325 and fourth arm 327 connected by fold line 326 disposed transversely across second support member 324 at substantially the midpoint along its longitudinal length. Fold line 326 acts as a hinge between third arm 325 and fourth arm 327 and enables second support member 324 to fold outwardly, away from common hinge point 308, when third elongated strip member 320 is pivoted about common hinge point 308 toward section 306 of first elongated strip member 302. So, when third elongated strip member 320 is pivoted about common hinge point 308 adjacent to section 306 of first elongated strip member 302, third arm 325 and fourth arm 327 of second support member 324 hinge about fold line 326 to a parallel relationship between adjacent surfaces of section 306 of first elongated strip member 302 and third elongated strip member 320. When the third elongated strip member 320 is pivoted about common hinge point 308, so it is substantially orthogonal to the plane of the first elongated strip member 302, second support member 324 is fully extended and obliquely disposed between strip members 302 and 320, preventing further pivotal rotation of third elongated strip member 320 away from section 306 of first elongated strip member 302.

When second elongated strip member 310 and third elongated strip member 320 are oppositely pivoted with respect to common hinge point 308 to positions orthogonal to the plane of first elongated strip member 302, first support member 314 and second support member 324 are fully extended. As such, first elongated strip member 302 is prevented from rotational movement with respect to common hinge point 308, and is in effect stabilized in that position.

Referring to FIG. 5, the connection of hinge 300 to sections 104 and 114 of enclosure member 102, and tray 126 will be described. As shown, the surface of first elongated strip member 302, opposite that from which common hinge point 308 is disposed, is fixed to the exterior of base 202 of tray 126. The surface of second elongated strip member 310, opposite that to which first support member 314 connects, is fixed to the interior surface of base 108 of section 104 of enclosure member 102. The surface of third elongated strip member 320, opposite that to which second support member 324 connects, is fixed to the interior surface of base 118 of section 114 of enclosure 102.

When display case is closed, as shown in FIG. 1, second elongated strip member 310 is adjacent section 304 of first elongated strip member 302 with first arm 315 and second arm 317 of first support member 314 hinged about fold line 316 and in a parallel relationship between these elongated strip members, and third elongated strip member 320 is adjacent to section 306 of first elongated strip member 302 with third arm 325 and fourth arm 327 of second support member 324 hinged about fold line 326 and in a parallel relationship beween these elongated strip members. When the display case is fully opened to display tray 126 and its contents, as shown in FIG. 3, second elongated strip member 310 and third elongated strip member 320 are orthogonal to the plane of first elongated strip member 302, and first and second support members 314 and 324, respectively, are fully extended. When display case 100 is fully opened, fully extended first and second support members 314 and 324 prevent tray 126 from any rotational movement about common hinge point 308, thereby, stabilizing tray 126 with respect to sections 104 and 114 of enclosure member 102 in the position shown in FIG. 3.

It is also contemplated that a combination display case can be formed by the adjacent disposition of two hingedly connected display cases 100. These display cases are hinged to each other at their end members 107 and 117. Two flat hinge is used for this purpose. In the closed position of the combination display case, bases 108 and 118 of the one display case are adjacent bases 108 and 118 of the other display case and the flat hinges which connect the end members of the two display cases together are remote from each other. In the open position, bases 108 and 118 of each display case are adjacent each other, as shown in FIG. 3, and the flat hinges, hingedly connecting the end members of the two display cases are adjacent to each other. In the open position, trays 126 of the two display cases 100 which make up the combination display case are fully exposed for access.

Although the preferred embodiment of the invention is a display case, it is contemplated that the present invention can be embodied as a container, or other type of housing or covering or packaging capable of being opened and closed for concealing and permitting access, respectively, to an article disposed on or in the tray.

The terms and expressions which are employed herein are used as terms of expression and not of limitation. And, there is no intention, in the use of such terms and expressions, of excluding the equivalents of the features shown, and described, or portions thereof, it being recognized that various modifications are possible in the scope of the invention.

I claim:

1. A container capable of being moved from an open position to a closed position, comprising:

an enclosure member comprising a first section and a second section, the first section and the second section being connected to each other at a common hinge point and being movable with respect to each other from an open position to a closed position and in a closed position defining a first cavity;

a tray member being arranged and constructed so that it is disposed within the first cavity when the first section and the second sections are in their closed position, and the tray member being exposed for access when the first section and the second section are in their open position; and hinge means for connecting and allowing movement among the first section, the second section, and the tray member, the hinge means being arranged and constructed so that the first section and the second section may be pivoted about the common hinge point, whereby the hinge means comprises a first elongated member attached to the tray member, a second elongated member attached to the first section, a third elongated member attached to the second section, with the second and third elongated members being pivotably connected to the first elongated member at substantially the same position along its longitudinal length, first support means connecting a first portion of the first elongated member and the second elongated member, second support means connecting a second portion of the first elongated member and the third elongated member, and when the container is in the open position the first support means and the second support means restrict pivotal movement of the tray member with respect to the first section and the second section.

2. The container as recited in claim 1, wherein the tray member has substantially the same shape as said cavity.

3. The container as recited in claim 1, wherein the first section and second portion are mirror images of each other.

4. The container as recited in claim 1, wherein the first support means comprises a first arm and a second arm connected by a first support hinge means, and the second support means comprises a third arm and a fourth arm connected by a second support hinge means, whereby when the container is in the closed position the first arm and the second arm are pivoted about the first support hinge means in parallel relationship and the third arm and the fourth arm are pivoted about the second support hinge means in parallel relationship.

5. The container as recited in claim 1, wherein the tray member has a second cavity defined therein for disposition of an article.

6. The hinge recited in claim 1, wherein a first end of the first support means is connected to the first portion of the first elongated member along its length spaced away from a common hinge point among the first elongated member, the second elongated member, and the third elongated member, and a second end of the first support means is connected to the second elongated member along its length spaced away from the common hinge point.

7. The hinge as recited in claim 1, wherein a first end of the second support means is connected to the second portion of the first elongated member along its length spaced away from a common hinge point among the first elongated member, the second elongated member, and the third elongated member, and a second end of the second support means is connected to the third elongated member along its length spaced away from the common hinge point.

* * * * *

UNITED STATES PATENT AND TRADEMARK OFFICE

CERTIFICATE OF CORRECTION

PATENT NO. : 4,681,216

DATED : Jul. 21, 1987

INVENTOR(S) : Philip P. Simkins

It is certified that error appears in the above-identified patent and that said Letters Patent is hereby corrected as shown below:

Column 2, line 58: "phanton" should be --phantom--

Column 3, line 32: "remove" should be --remote--

Column 3, line 38: "to" should be --top--

Column 8, line 11: "portion" should be --section--

Signed and Sealed this

Twenty-second Day of March, 1988

*Attest:*

DONALD J. QUIGG

*Attesting Officer*

*Commissioner of Patents and Trademarks*